US008296968B2

(12) United States Patent
Hensley

(10) Patent No.: US 8,296,968 B2
(45) Date of Patent: Oct. 30, 2012

(54) SURFACE DRYING APPARATUS AND METHOD

(76) Inventor: Charles Hensley, Stanford, KY (US)

( * ) Notice: Subject to any disclaimer, the term of this patent is extended or adjusted under 35 U.S.C. 154(b) by 2745 days.

(21) Appl. No.: 10/865,960

(22) Filed: Jun. 12, 2004

(65) Prior Publication Data

US 2005/0000109 A1 Jan. 6, 2005

Related U.S. Application Data

(60) Provisional application No. 60/478,658, filed on Jun. 13, 2003.

(51) Int. Cl.
*F26B 25/06* (2006.01)

(52) U.S. Cl. ..... 34/381; 34/413; 34/90; 347/62; 392/301; 166/60

(58) Field of Classification Search ..... 34/408, 34/425, 96, 97, 107, 381, 413, 497, 524, 34/80, 90, 210, 78; 392/384, 385, 301; 166/60; 347/62

See application file for complete search history.

(56) References Cited

U.S. PATENT DOCUMENTS

| | | | | | |
|---|---|---|---|---|---|
| 743,021 | A | * | 11/1903 | Nesmith et al. | 126/271.2 R |
| 1,384,943 | A | * | 7/1921 | Ferguson | 431/209 |
| 1,520,956 | A | * | 12/1924 | Kusebauch | 110/162 |
| 1,681,104 | A | * | 8/1928 | Earnhardt | 126/271.2 A |
| 1,722,843 | A | * | 7/1929 | Fasul | 239/130 |
| 1,899,704 | A | | 2/1933 | Lutz | |
| 2,060,516 | A | * | 11/1936 | McIntyre | 431/248 |
| 2,093,840 | A | * | 9/1937 | Kulczak | 37/227 |
| 2,128,779 | A | * | 8/1938 | Knight | 404/112 |
| 2,513,480 | A | * | 7/1950 | Heth | 432/55 |
| 3,105,484 | A | * | 10/1963 | Goff | 431/326 |
| 3,160,154 | A | * | 12/1964 | Sowell | 126/271.2 A |

(Continued)

FOREIGN PATENT DOCUMENTS

JP 02300402 A * 12/1990

(Continued)

OTHER PUBLICATIONS

Frank P. Incropera & David P De Witt, Fundamentals of Heat and Mass Transfer, 1985, John Wiley & Sons, United States of America.

*Primary Examiner* — Stephen M. Gravini
(74) *Attorney, Agent, or Firm* — Robert R. Waters; Brian W. Foxworthy; Waters Law Group, PLLC

(57) ABSTRACT

An apparatus and method for quickly and effectively drying ground surfaces are disclosed and claimed. The invention has particular utility in the drying of a race track surface. The invention consists of a means for blowing air upon the surface, a means for heating the air and a means for moving the apparatus with respect to the surface to provide flexibility and control in the degree of drying/heating performed. The apparatus and method may be applied to a variety of surfaces including earthen (dirt) surfaces, concrete and asphalt. One of the objectives of the device is to enable the drying of a track surface such that the surface will not be damaged by overheating which can otherwise occur with other track drying devices applied to an asphalt surface in particular. The design of the invention makes specific use of enhanced turbulent air flow at the surface in order to improve performance over a purely laminar air flow.

17 Claims, 6 Drawing Sheets

U.S. PATENT DOCUMENTS

| | | | | |
|---|---|---|---|---|
| 3,223,079 | A * | 12/1965 | Keusder et al. | 126/271.2 A |
| 3,279,458 | A * | 10/1966 | Moench | 126/271.2 R |
| 3,291,118 | A * | 12/1966 | La Roy | 126/271.2 R |
| 3,442,262 | A * | 5/1969 | Porterfield et al. | 126/271.2 B |
| 3,675,600 | A * | 7/1972 | Jones | 110/203 |
| 3,698,380 | A * | 10/1972 | Cook | 126/271.2 A |
| 3,805,766 | A * | 4/1974 | Hammon | 126/271.2 R |
| 3,840,321 | A * | 10/1974 | Moench | 431/11 |
| 3,847,137 | A * | 11/1974 | Lambertoni | 126/271.2 A |
| 3,970,071 | A * | 7/1976 | Miller et al. | 126/271.1 |
| 3,989,390 | A * | 11/1976 | Thorner | 401/42 |
| 3,989,391 | A * | 11/1976 | Thorner | 401/43 |
| 4,432,645 | A * | 2/1984 | Frungel | 356/338 |
| 4,529,497 | A * | 7/1985 | Watson et al. | 208/419 |
| 4,557,626 | A | 12/1985 | McKay et al. | |
| 4,559,922 | A | 12/1985 | Crupi et al. | |
| 4,561,800 | A | 12/1985 | Hatakenaka et al. | |
| 4,608,126 | A * | 8/1986 | Watson et al. | 202/84 |
| 4,711,600 | A | 12/1987 | Yates | |
| 4,749,303 | A * | 6/1988 | Keizer et al. | 404/86 |
| 4,955,721 | A * | 9/1990 | Clark et al. | 366/24 |
| 4,990,939 | A * | 2/1991 | Sekiya et al. | 347/62 |
| 5,020,510 | A | 6/1991 | Jones | |
| 5,114,284 | A | 5/1992 | Keizer et al. | |
| 5,188,481 | A | 2/1993 | O'Brien | |
| 5,251,281 | A * | 10/1993 | Fravel, Jr. | 392/384 |
| 5,305,533 | A * | 4/1994 | Alexander et al. | 34/549 |
| 5,682,683 | A * | 11/1997 | Haimer | 34/425 |
| 5,797,203 | A | 8/1998 | Vanderlinden | |
| 5,895,171 | A | 4/1999 | Wiley et al. | |
| 6,090,218 | A * | 7/2000 | Brackmann et al. | 134/15 |
| 6,126,081 | A * | 10/2000 | Calvin et al. | 237/12.3 B |
| 6,149,478 | A * | 11/2000 | Lehmann | 440/88 R |
| 6,168,709 | B1 * | 1/2001 | Etter | 208/131 |
| 6,189,179 | B1 * | 2/2001 | Baird | 15/364 |
| 6,223,742 | B1 * | 5/2001 | Macameau | 126/343.5 R |
| 6,227,453 | B1 * | 5/2001 | Calvin et al. | 237/69 |
| 6,325,297 | B1 * | 12/2001 | Calvin et al. | 237/12.3 B |
| 6,371,689 | B1 | 4/2002 | Wiley | |
| 6,416,249 | B1 * | 7/2002 | Crupi | 404/91 |
| 6,551,017 | B1 | 4/2003 | Strassman | |
| 6,669,467 | B2 | 12/2003 | Kieswetter | |
| 6,714,837 | B1 * | 3/2004 | Brackmann et al. | 700/231 |
| 6,742,959 | B2 | 6/2004 | Strassman | |
| 6,877,555 | B2 * | 4/2005 | Karanikas et al. | 166/245 |
| 6,880,633 | B2 * | 4/2005 | Wellington et al. | 166/245 |
| 6,915,850 | B2 * | 7/2005 | Vinegar et al. | 166/272.2 |
| 6,918,442 | B2 * | 7/2005 | Wellington et al. | 166/245 |
| 6,918,443 | B2 * | 7/2005 | Wellington et al. | 166/245 |
| 6,923,257 | B2 * | 8/2005 | Wellington et al. | 166/245 |
| 6,929,067 | B2 * | 8/2005 | Vinegar et al. | 166/302 |
| 6,932,155 | B2 * | 8/2005 | Vinegar et al. | 166/245 |
| 6,948,562 | B2 * | 9/2005 | Wellington et al. | 166/272.1 |
| 6,951,247 | B2 * | 10/2005 | de Rouffignac et al. | 166/245 |
| 6,964,300 | B2 * | 11/2005 | Vinegar et al. | 166/245 |
| 6,966,374 | B2 * | 11/2005 | Vinegar et al. | 166/272.3 |
| 6,969,123 | B2 * | 11/2005 | Vinegar et al. | 299/3 |
| 6,981,548 | B2 * | 1/2006 | Wellington et al. | 166/245 |
| 6,984,670 | B2 * | 1/2006 | Meyers et al. | 521/40 |
| 6,991,032 | B2 * | 1/2006 | Berchenko et al. | 166/245 |
| 6,991,033 | B2 * | 1/2006 | Wellington et al. | 166/245 |
| 6,991,036 | B2 * | 1/2006 | Sumnu-Dindoruk et al. | 166/302 |
| 6,991,045 | B2 * | 1/2006 | Vinegar et al. | 175/45 |
| 6,994,169 | B2 * | 2/2006 | Zhang et al. | 166/302 |
| 6,997,518 | B2 * | 2/2006 | Vinegar et al. | 299/5 |
| 7,004,247 | B2 * | 2/2006 | Cole et al. | 166/60 |
| 7,004,251 | B2 * | 2/2006 | Ward et al. | 166/245 |
| 7,011,154 | B2 * | 3/2006 | Maher et al. | 166/245 |
| 7,013,972 | B2 * | 3/2006 | Vinegar et al. | 166/257 |
| 7,032,660 | B2 * | 4/2006 | Vinegar et al. | 166/245 |
| 7,040,398 | B2 * | 5/2006 | Wellington et al. | 166/245 |
| 7,040,399 | B2 * | 5/2006 | Wellington et al. | 166/245 |
| 7,040,400 | B2 * | 5/2006 | de Rouffignac et al. | 166/245 |
| 7,051,807 | B2 * | 5/2006 | Vinegar et al. | 166/245 |
| 7,051,808 | B1 * | 5/2006 | Vinegar et al. | 166/250.1 |
| 7,051,811 | B2 * | 5/2006 | de Rouffignac et al. | 166/302 |
| 7,055,600 | B2 * | 6/2006 | Messier et al. | 166/250.01 |
| 7,063,145 | B2 * | 6/2006 | Veenstra et al. | 166/250.01 |
| 7,066,254 | B2 * | 6/2006 | Vinegar et al. | 166/245 |
| 7,066,257 | B2 * | 6/2006 | Wellington et al. | 166/272.2 |
| 7,077,198 | B2 * | 7/2006 | Vinegar et al. | 166/245 |
| 7,077,199 | B2 * | 7/2006 | Vinegar et al. | 166/250.01 |
| 7,086,465 | B2 * | 8/2006 | Wellington et al. | 166/272.1 |
| 7,090,013 | B2 * | 8/2006 | Wellington | 166/267 |
| 7,096,942 | B1 * | 8/2006 | de Rouffignac et al. | 166/245 |
| 7,100,994 | B2 * | 9/2006 | Vinegar et al. | 299/7 |
| 7,104,319 | B2 * | 9/2006 | Vinegar et al. | 166/245 |
| 7,121,342 | B2 * | 10/2006 | Vinegar et al. | 166/302 |
| 7,128,153 | B2 * | 10/2006 | Vinegar et al. | 166/285 |
| 7,156,176 | B2 * | 1/2007 | Vinegar et al. | 166/302 |
| 7,165,615 | B2 * | 1/2007 | Vinegar et al. | 166/302 |
| 7,175,362 | B2 * | 2/2007 | Carr et al. | 404/17 |
| 7,220,365 | B2 * | 5/2007 | Qu et al. | 252/70 |
| 7,225,866 | B2 * | 6/2007 | Berchenko et al. | 166/245 |
| 7,297,720 | B2 * | 11/2007 | Meyers et al. | 521/40 |
| 7,320,364 | B2 * | 1/2008 | Fairbanks | 166/302 |
| 7,353,872 | B2 * | 4/2008 | Sandberg | 166/302 |
| 7,357,180 | B2 * | 4/2008 | Vinegar et al. | 166/254.1 |
| 7,360,588 | B2 * | 4/2008 | Vinegar et al. | 166/59 |
| 7,370,704 | B2 * | 5/2008 | Harris | 166/302 |
| 7,383,877 | B2 * | 6/2008 | Vinegar et al. | 166/60 |
| 7,421,334 | B2 * | 9/2008 | Dahlgren et al. | 701/117 |
| 7,424,915 | B2 * | 9/2008 | Vinegar | 166/302 |
| 7,431,076 | B2 * | 10/2008 | Sandberg et al. | 166/60 |
| 7,461,691 | B2 * | 12/2008 | Vinegar et al. | 166/60 |
| 7,481,274 | B2 * | 1/2009 | Vinegar et al. | 166/302 |
| 7,490,665 | B2 * | 2/2009 | Sandberg et al. | 166/60 |
| 7,500,528 | B2 * | 3/2009 | McKinzie et al. | 175/17 |
| 7,510,000 | B2 * | 3/2009 | Pastor-Sanz et al. | 166/60 |
| 7,527,094 | B2 * | 5/2009 | McKinzie et al. | 166/250.07 |
| 7,533,719 | B2 * | 5/2009 | Hinson et al. | 166/75.11 |
| 7,540,324 | B2 * | 6/2009 | de Rouffignac et al. | 166/245 |
| 7,546,873 | B2 * | 6/2009 | Kim et al. | 166/245 |
| 7,549,470 | B2 * | 6/2009 | Vinegar et al. | 166/245 |
| 7,556,095 | B2 * | 7/2009 | Vinegar | 166/250.01 |
| 7,556,096 | B2 * | 7/2009 | Vinegar et al. | 166/250.01 |
| 7,559,367 | B2 * | 7/2009 | Vinegar et al. | 166/272.3 |
| 7,559,368 | B2 * | 7/2009 | Vinegar et al. | 166/272.6 |
| 7,562,706 | B2 * | 7/2009 | Li et al. | 166/245 |
| 7,562,707 | B2 * | 7/2009 | Miller | 166/245 |
| 7,575,052 | B2 * | 8/2009 | Sandberg et al. | 166/248 |
| 7,575,053 | B2 * | 8/2009 | Vinegar et al. | 166/250.14 |
| 7,581,589 | B2 * | 9/2009 | Roes et al. | 166/267 |
| 7,584,789 | B2 * | 9/2009 | Mo et al. | 166/267 |
| 7,591,310 | B2 * | 9/2009 | Minderhoud et al. | 166/267 |
| 7,597,147 | B2 * | 10/2009 | Vitek et al. | 166/302 |
| 7,604,052 | B2 * | 10/2009 | Roes et al. | 166/267 |
| 7,610,962 | B2 * | 11/2009 | Fowler | 166/267 |
| 7,628,150 | B2 * | 12/2009 | Malkov | 126/271.1 |
| 7,631,689 | B2 * | 12/2009 | Vinegar et al. | 166/245 |
| 7,631,690 | B2 * | 12/2009 | Vinegar et al. | 166/245 |
| 7,635,023 | B2 * | 12/2009 | Goldberg et al. | 166/245 |
| 7,635,024 | B2 * | 12/2009 | Karanikas et al. | 166/245 |
| 7,635,025 | B2 * | 12/2009 | Vinegar et al. | 166/272.3 |
| 7,640,980 | B2 * | 1/2010 | Vinegar et al. | 166/268 |
| 7,644,765 | B2 * | 1/2010 | Stegemeier et al. | 166/302 |
| 7,673,681 | B2 * | 3/2010 | Vinegar et al. | 166/252.1 |
| 7,673,786 | B2 * | 3/2010 | Menotti | 228/214 |
| 7,677,310 | B2 * | 3/2010 | Vinegar et al. | 166/272.1 |
| 7,677,314 | B2 * | 3/2010 | Hsu | 166/302 |
| 7,681,647 | B2 * | 3/2010 | Mudunuri et al. | 166/302 |
| 7,683,296 | B2 * | 3/2010 | Brady et al. | 219/553 |
| 7,703,513 | B2 * | 4/2010 | Vinegar et al. | 166/245 |
| 7,717,171 | B2 * | 5/2010 | Stegemeier et al. | 166/261 |
| 7,730,945 | B2 * | 6/2010 | Pieterson et al. | 166/272.1 |
| 7,730,946 | B2 * | 6/2010 | Vinegar et al. | 166/272.3 |
| 7,730,947 | B2 * | 6/2010 | Stegemeier et al. | 166/272.3 |
| 7,735,935 | B2 * | 6/2010 | Vinegar et al. | 299/5 |
| 7,785,427 | B2 * | 8/2010 | Maziasz et al. | 148/327 |
| 7,793,722 | B2 * | 9/2010 | Vinegar et al. | 166/302 |
| 7,798,220 | B2 * | 9/2010 | Vinegar et al. | 166/272.3 |
| 7,806,625 | B2 * | 10/2010 | Carr et al. | 404/75 |
| 7,831,134 | B2 * | 11/2010 | Vinegar et al. | 392/301 |
| 7,832,484 | B2 * | 11/2010 | Nguyen et al. | 166/302 |
| 7,841,401 | B2 * | 11/2010 | Kuhlman et al. | 166/245 |
| 7,841,408 | B2 * | 11/2010 | Vinegar | 166/272.3 |
| 7,841,425 | B2 * | 11/2010 | Mansure et al. | 175/57 |

| | | | | |
|---|---|---|---|---|
| 7,845,411 | B2 * | 12/2010 | Vinegar et al. | 166/302 |
| 7,849,922 | B2 * | 12/2010 | Vinegar et al. | 166/272.1 |
| 7,860,377 | B2 * | 12/2010 | Vinegar et al. | 392/301 |
| 7,866,385 | B2 * | 1/2011 | Lambirth | 166/256 |
| 7,866,386 | B2 * | 1/2011 | Beer et al. | 166/258 |
| 7,866,388 | B2 * | 1/2011 | Bravo | 166/267 |
| 7,901,154 | B2 * | 3/2011 | Carr et al. | 404/6 |
| 2002/0179493 | A1 * | 12/2002 | Etter | 208/131 |
| 2003/0066638 | A1 * | 4/2003 | Qu et al. | 165/186 |
| 2003/0170075 | A1 | 9/2003 | Strassman | |
| 2003/0213502 | A1 * | 11/2003 | Eriksson | 134/10 |
| 2004/0022994 | A1 * | 2/2004 | Higgins et al. | 428/95 |
| 2004/0058095 | A1 * | 3/2004 | Carr et al. | 428/17 |
| 2005/0035484 | A1 * | 2/2005 | Meyers, III et al. | 264/162 |
| 2005/0065711 | A1 * | 3/2005 | Dahlgren et al. | 701/117 |
| 2005/0281999 | A1 * | 12/2005 | Hofmann et al. | 428/304.4 |
| 2006/0032788 | A1 * | 2/2006 | Etter | 208/131 |
| 2006/0058404 | A1 * | 3/2006 | Meyers et al. | 521/40 |
| 2008/0032069 | A1 * | 2/2008 | Carr et al. | 428/17 |
| 2008/0216712 | A1 * | 9/2008 | Bailey | 106/464 |
| 2008/0287053 | A1 * | 11/2008 | Carlson et al. | 454/365 |
| 2009/0000222 | A1 * | 1/2009 | Kalkanoglu et al. | 52/173.3 |
| 2009/0044934 | A1 * | 2/2009 | Malkov | 165/185 |
| 2009/0172968 | A1 * | 7/2009 | Hensley | 34/467 |
| 2009/0320713 | A1 * | 12/2009 | Amiri | 104/281 |
| 2010/0028078 | A1 * | 2/2010 | Carr et al. | 404/31 |
| 2010/0030709 | A1 * | 2/2010 | Carr | 705/500 |
| 2010/0203290 | A1 * | 8/2010 | Whitaker et al. | 428/144 |
| 2010/0235206 | A1 * | 9/2010 | Miller et al. | 705/7 |
| 2010/0258265 | A1 * | 10/2010 | Karanikas et al. | 165/45 |
| 2010/0258290 | A1 * | 10/2010 | Bass | 166/60 |
| 2010/0258291 | A1 * | 10/2010 | de St. Remey et al. | 166/60 |
| 2010/0258309 | A1 * | 10/2010 | Ayodele et al. | 166/272.3 |
| 2011/0042084 | A1 * | 2/2011 | Bos et al. | 166/272.1 |

FOREIGN PATENT DOCUMENTS

| | | | | |
|---|---|---|---|---|
| JP | 03021702 | A | * | 1/1991 |
| JP | 05321204 | A | * | 12/1993 |
| JP | 06287907 | A | * | 10/1994 |
| JP | 07034408 | A | * | 2/1995 |
| JP | 08326009 | A | * | 12/1996 |
| JP | 09143916 | A | * | 6/1997 |
| JP | 09328708 | A | * | 12/1997 |
| JP | 10131112 | A | * | 5/1998 |
| JP | 2000096509 | A | * | 4/2000 |
| JP | 2001081710 | A | * | 3/2001 |
| JP | 2001081725 | A | * | 3/2001 |
| JP | 2006144379 | A | * | 6/2006 |
| JP | 2008007936 | A | * | 1/2008 |
| WO | WO 9750279 | A1 | * | 12/1997 |

* cited by examiner

Figure 6.17 Comparison of laminar and turbulent velocity boundary layer profiles for the same freestream velocity.

SURFACE DRYING APPARATUS AND METHOD

CROSS REFERENCE TO RELATED APPLICATIONS

This application claims priority from U.S. provisional application 60/478,658, filed on Jun. 13, 2003. This application relates to a method and apparatus for drying a surface such as an earthen, asphalt or concrete driving surface. The entire disclosure contained in U.S. provisional application 60/478,658, including the attachments thereto, is incorporated herein by reference.

BACKGROUND OF THE INVENTION

1. Field of the Invention

The present invention is directed to a method and apparatus for quickly and effectively drying surfaces including asphalt, concrete, and earthen surfaces without overheating the surface such as to damage the surface material or surface finish. The invention has particular utility in the area of drying racetrack surfaces.

2. Description of the Related Art

Motorized racing has become a very popular entertainment form in the United States and abroad, drawing audiences of up to many thousands of people at a racing event. Motorized racing also takes a number of forms including motorcycle racing, NASCAR®, drag racing, and others. All of these forms of racing feature motorized vehicles traveling at a high rate of speed, and the condition of the track is a prime concern at such an event. All of these forms of racing are heavily dependent on the availability of a track surface that is dry and uniform in order to achieve commonly accepted margins of safety. When rain is experienced, a race has to be delayed or temporarily stopped, which of course, causes a considerable inconvenience for racers and spectators alike. It is important after a brief experience of rain that the track be quickly dried so that the race can resume.

Track surfaces vary widely in motorized racing. Most large commercial tracks feature an asphalt surface, although concrete or other surface materials are possible. Dirt tracks are also common, especially at smaller racing venues. In addition to surface material variations, racing tracks vary widely in design with most featuring banking of the track in the turns. The degree of banking as well as the tightness of the turns varies greatly from track to track. In addition, since racing tracks are dispersed around the world, environmental conditions often play a significant role in track design, and characteristics such as humidity and the likelihood of rainfall add variables that must be taken into consideration in track maintenance.

In order to dry a track after rain concludes, a track dryer may be used to dry the surface of the track to an acceptable level of dryness such that racing can resume. A variety of instruments has been used in the past with varying degrees of success. One kind of track dryer that has been employed is the Jet Dryer by Eagle Enterprises. The Eagle device is essentially a jet engine mounted on a wheeled frame and oriented to blow jet exhaust directly onto the track surface. Although effective in drying most surfaces, the Eagle device suffers from significant drawbacks, including the very high cost of jet fuel. The device may be adapted to use gasoline, but still suffers from the disadvantage that it uses an enormous amount of fuel in relation to the amount of area dried. In addition, due to the nature of the device, the jet dryer functions very poorly on a banked surface such as race track turns.

Severe noise pollution is also a significant drawback. In addition, the jet dryer is inadequate on a dirt surface as it creates an enormous amount of airborne dust.

Another system widely used features the application of a direct flame placed upon the track surface, essentially scorching the moisture out of the track. Other systems occasionally used are loosely based on devices designed to heat asphalt for repair purposes. As such, they are generally large and result in the application of a high degree of heat directly upon the surface. These systems are largely inadequate as they can cause considerable damage to the track surface by drawing and burning petroleum components from the asphalt. If an asphalt surface is repeatedly dried by such a means, over time, the upper surfaces of the asphalt will become brittle and deteriorate due to the drawing of oil from the asphalt. In addition, systems featuring a direct flame cannot be used to clean up an oil spill or an oil slick caused by an accident. It would be advantageous to have a track drying mechanism that can also be used to clean an oil spill from the track.

Examining the patent art for track heating or drying mechanisms, the bulk of such art relates to devices for reconditioning asphalt pavement. As such, these patents attempt to uniformly and homogeneously heat the pavement to a temperature that softens it for removal and reprocessing without creating hot spots. Excessively high temperatures in this process may result in smoking which is the removal of some of the petroleum components of the asphalt. Typical of the relevant art and perhaps the most pertinent is U.S. Pat. No. 4,561,800 by Hatakenaka et al. which uses hot air convection to soften the asphalt. In its preferred embodiment, Hatakenaka uses a heat source, a temperature sensor, a large enclosure in close proximity to the asphalt, adjustable vents within the enclosure, and a blower to move the air. The temperature sensor is used in a feedback loop to adjust the amount of heat added to the air.

Hatakenaka features ducting to connect these elements in a nearly closed circuit with a discharge port located above the heat source. The fan pushes the air past the heat source with some air leaving through the discharge port. Next, the air travels past the sensor on its way to the vents within the large enclosure where the heated air is directed evenly towards the asphalt while being mostly retained within the large enclosure. The heated air is drawn from the enclosure back into the ductwork along with some ambient air from the edges of the enclosure, passes through the blower, and flows past the discharge port on its way to the heat source to be reheated for the next pass at the asphalt.

Very similar to Hatakenaka are U.S. Pat. No. 6,371,689 B1 by Wiley et al. and U.S. Pat. No. 4,599,922 by Crupi et al. Wiley also uses hot air convection in a mostly closed flow path with feedback temperature controls to soften the asphalt. However, Wiley '689 monitors the temperature of the air after it is drawn back off of the pavement from the enclosure but before it enters the blower. The stated purpose for this is to use the temperature of the air coming off the pavement as a proxy to monitor the temperature of the pavement so as not to exceed a critical temperature for the pavement. Crupi predates both Hatekenaka and Wiley '689 and while it does use an essentially closed flow path and a large enclosure, Crupi places the blower after the heat source and does not use a feedback control loop on the heat source.

The U.S. Pat. No. 4,749,303 by Keizer et al. and U.S. Pat. No. 5,895,171 by Wiley et al. use radiant heat to soften the asphalt. Keizer forces a fuel-air mixture through a refractory blanket to burn on the blankets underside. The blanket then radiates heat to the pavement. Wiley '171 utilizes both convection heat and radiant heat transfer to heat the pavement. In Wiley '171, heated air circulating in an essentially closed loop passes through a perforated plate located near the pavement. The air heats the plate which then radiates to the pavement and then the air flows to the pavement for convection heat transfer to the pavement.

Another related patent from a field slightly different from asphalt rework is U.S. Pat. No. 5,020,510 by Jones. Jones uses hot air diffused into a large downwardly open enclosure on wheels to apply heat to large areas of ground. The apparatus can be towed and the temperatures are sufficient to kill grass, weeds and seeds on the ground.

All of the prior art devices described above suffer from one or more drawbacks that severely limit utility with respect to economical and effective track drying. Many of the prior art devices utilize direct flame or excessive heat which precludes the device from being used to clean an oil spill from the track. Furthermore, some of the devices are excessively heavy and bulky and cannot be maneuvered on a banked track. As mentioned earlier, many of the prior art devices actually damage the surface of the asphalt tracks by drawing petroleum components from the asphalt which damages the surface over time. In addition, the prior art devices are generally ineffective to use on drying a dirt track. What is needed is a track drying device that is economical to operate, easy to maneuver, relatively lightweight, and overcomes the various disadvantages in the prior art noted above. The present invention achieves those purposes entirely.

SUMMARY OF THE INVENTION

The present invention is an apparatus for drying driving surfaces, particularly dirt and pavement at race tracks and drag strips. The preferred embodiment of the invention is a drying apparatus comprised of a portable unit mounted on a two wheel, single axle trailer to be pulled by another vehicle. The apparatus is further comprised of a heating unit, preferably utilizing propane as a fuel, although other arrangements are possible. The apparatus of the preferred embodiment further comprises a variable velocity blower for directing heated or unheated air against the road surface to achieve evaporation or drying. The apparatus further comprises associated duct work and a damper for providing the separation of the heating and blowing functions of the device.

In another embodiment, the surface drying apparatus may be mounted in the bed of a pickup truck, thereby avoiding the need for a supplemental trailer. Alternatively, the bed of the pickup truck may be removed and the drying apparatus mounted directly upon the truck frame in lieu of a pickup truck bed.

Accordingly it is an objective of this invention to direct heated air at the driving surface to accomplish a safe and effective drying of a track surface.

It is also an objective of this invention to enable the operator of the apparatus to separate the heating and high velocity blowing operation such that the track may be dried with unheated air in occasions in which it would be advisable to do so. This feature would have particular utility in the area of drying an oil slick which has been treated with a chemical absorbent compound.

It is another objective of this invention to enable air to be directed at the track surface at such a velocity as to dispel collected, puddled or beaded water from the driving surface.

It is a further objective of this invention to be able to generate turbulent air flow at the driving surface level to enhance evaporation from the surface.

It is yet another objective of this invention to provide an economical apparatus that is economical to construct and economical to operate in terms of fuel cost.

It is a still further objective of this invention to be easy to operate and maneuver, allowing it to be backed up, turned in a relatively small radius or operated on banked turns, etc.

As discussed above, the method and device of the present invention overcomes the disadvantages inherent in prior art methods and devices. In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purposes of description and should not be regarded as limiting.

Accordingly, those skilled in the art will appreciate that the conception upon which this invention is based may readily be utilized as the basis for other structures, methods, and systems for carrying out the purposes of the present invention. It is important, therefore, that the specification be regarded as including such equivalent constructions insofar as they do not depart from the spirit of the present invention.

Furthermore, the purpose of the foregoing abstract is to enable the U.S. Patent and Trademark Office and the public generally, and especially including the practitioners in the art who are not familiar with patent or legal terms or phraseology, to determine quickly from a cursory inspection, the nature and essence of the technical disclosure of the application. The Abstract is neither intended to define the invention of the application nor is it intended to be limiting to the scope of the invention in any way.

BRIEF DESCRIPTION OF THE DRAWINGS

Additional utility and features of this invention will become more fully apparent to those skilled in the art by reference to the following drawings.

DESCRIPTION OF THE PREFERRED EMBODIMENT

Figure 1:
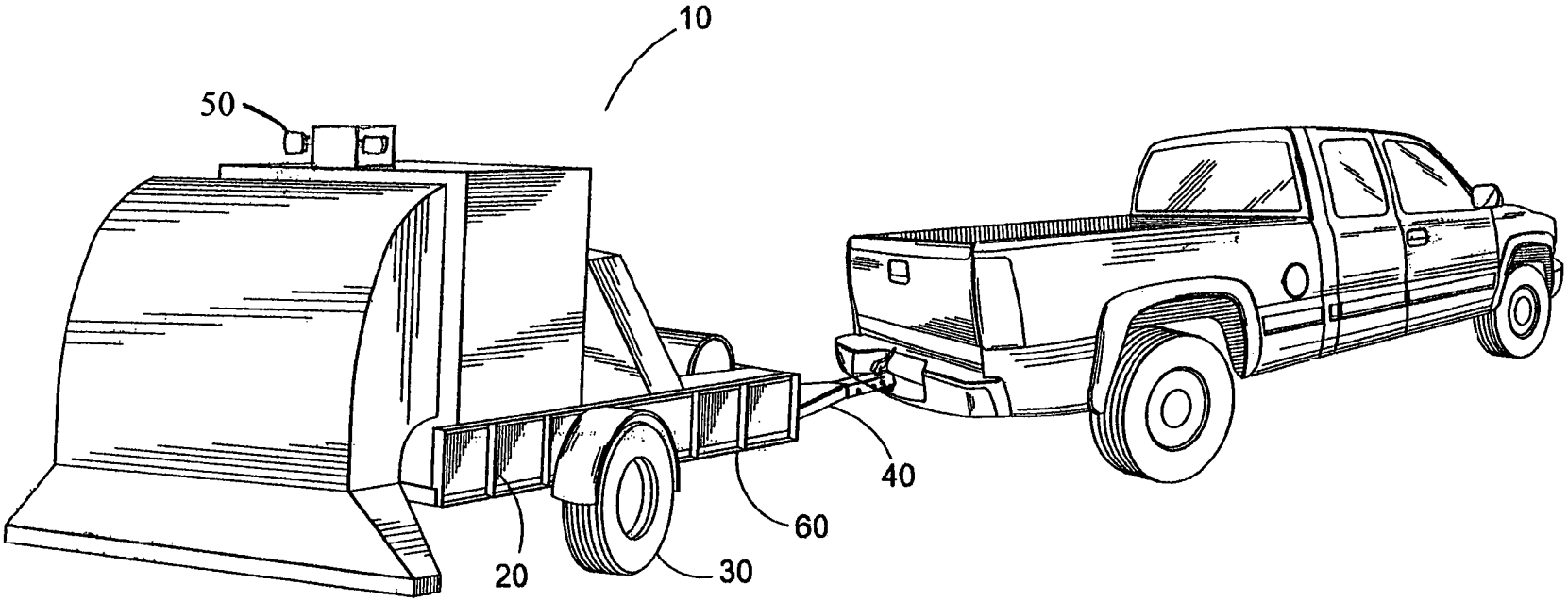
FIG. 1 shows the ground surface drying apparatus of a preferred embodiment being towed by a vehicle.

FIG. 1 shows the preferred embodiment of the ground surface drying apparatus 10. FIG. 1 illustrates the size of the preferred embodiment relative to a towing vehicle, it's ability to travel public roadways, and it's general maneuverability. The preferred embodiment is self-contained on it's own chassis 20 or frame, having two wheels 30 and a hitch 40 allowing it to be towed by any suitable vehicle such as a car, truck, or tractor, upon which all the other elements of this invention are mounted. The drying apparatus 10 is of a width and length appropriate for being towed on public roads as well as for its functional purpose and has the appropriate signals 50 etc. needed for public roads. Just above the axle of the wheels 30 is a lower deck 60 upon which most of the other elements of the invention are mounted. Around three sides of the chassis 20 are rails supported by vertical members rising up from the previously mentioned deck 60. The un-railed side is the rear of the trailer, opposite the hitch 40.

Figure 2:
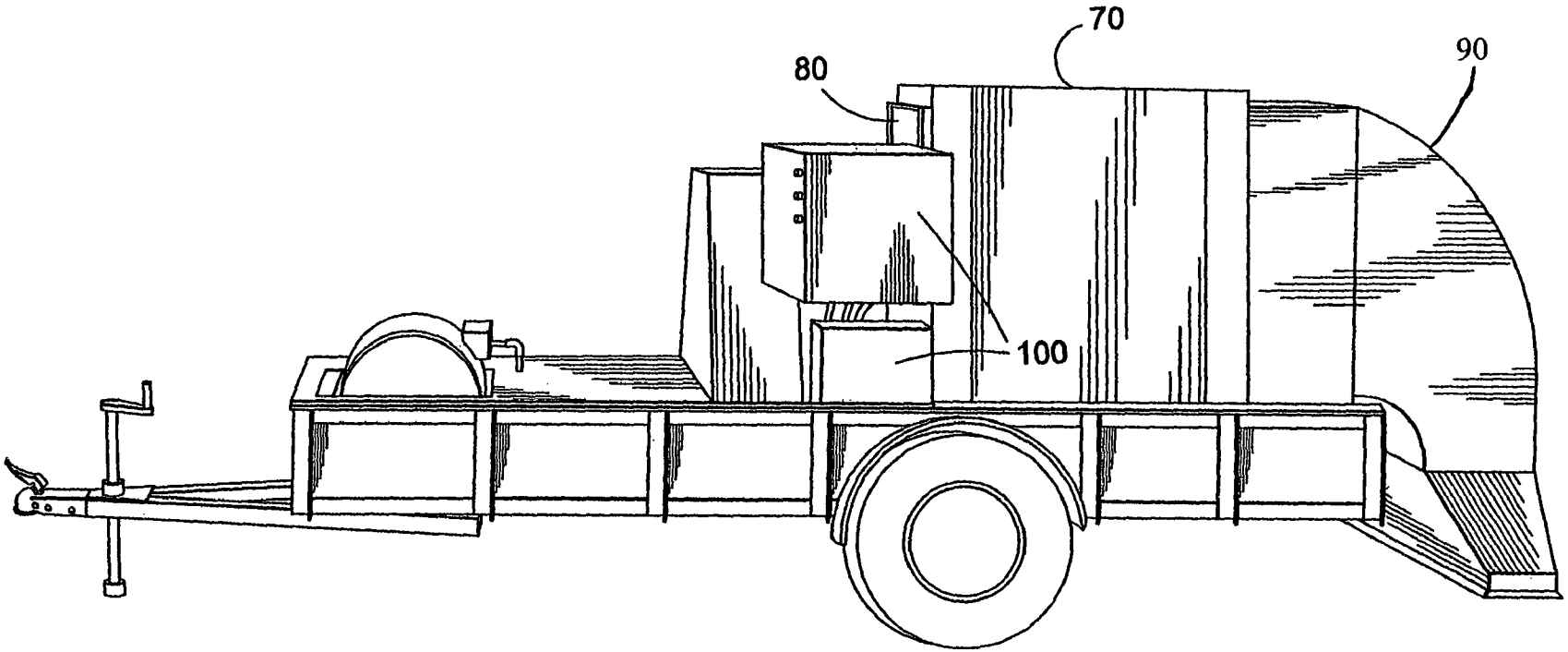
FIG. 2 is a side view of the preferred embodiment of the ground surface drying apparatus.
Figure 3:
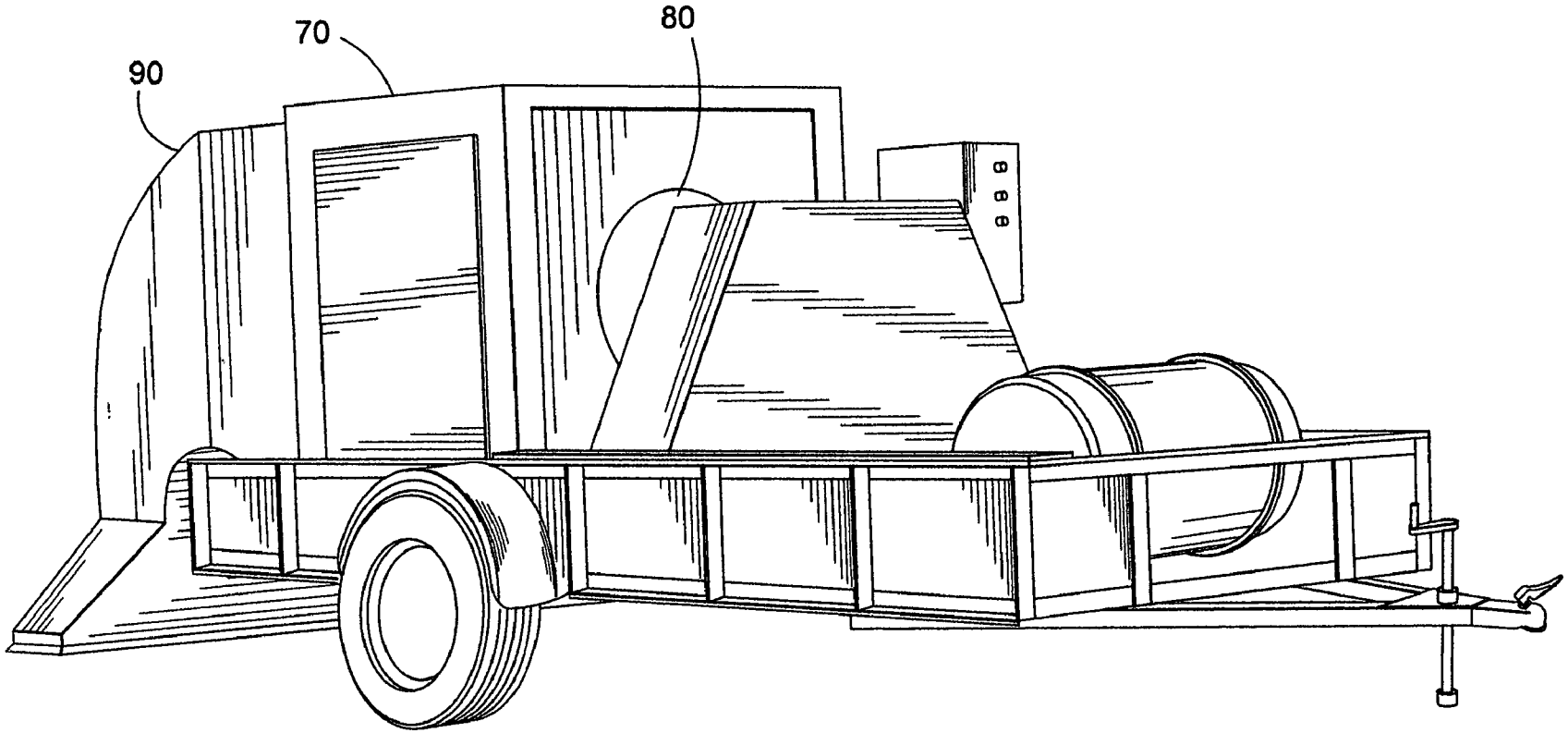
FIG. 3 is a front corner view of the preferred embodiment of the ground surface drying apparatus.

Now, reference will made to FIG. 2 and FIG. 3, where the same numbers will be used as were used in FIG. 1 for the same elements. At the rear of the drying apparatus 10, beginning near the axle and extending to about a foot from the end of the chassis 20 is a large, nearly cubic enclosure, this is the fan box 70. A fan intake 80 is centered on the side that faces toward the front of the drying apparatus 10. This is most visible in FIG. 3. From the back end of the fan box 70 extends a duct 90, very nearly matching the dimensions of that side of the fan box 70. Located within the duct 90 is a heater which, in the preferred embodiment, uses a gaseous fuel. As the duct 90 extends from the fan box 70, it bends ninety degrees downward towards the ground and reduces significantly in cross sectional area by decreasing the dimension previously matching the height of the fan box 70. The width of the duct 90 is maintained the same during this ninety degree redirection.

At a location approximately a third of the way from the deck 60 to the rail and slightly off the end of the chassis 20, the duct 90 begins changing its cross section again as it continues straight toward the ground. The dimension now running front to back continues to decrease while the width of the duct 90 increases to approximately the width at the wheels 30. The duct 90 opens a few inches from the ground having a cross section substantially less than it started with on the back of the fan box 70. Central in FIG. 2, above the wheels, are located control boxes 100 for the apparatus 10. Within control boxes 100 are controls typically required for industrial heating units fueled by a flammable gas including safety controls generally understood by a person familiar with the art.

Figure 4:
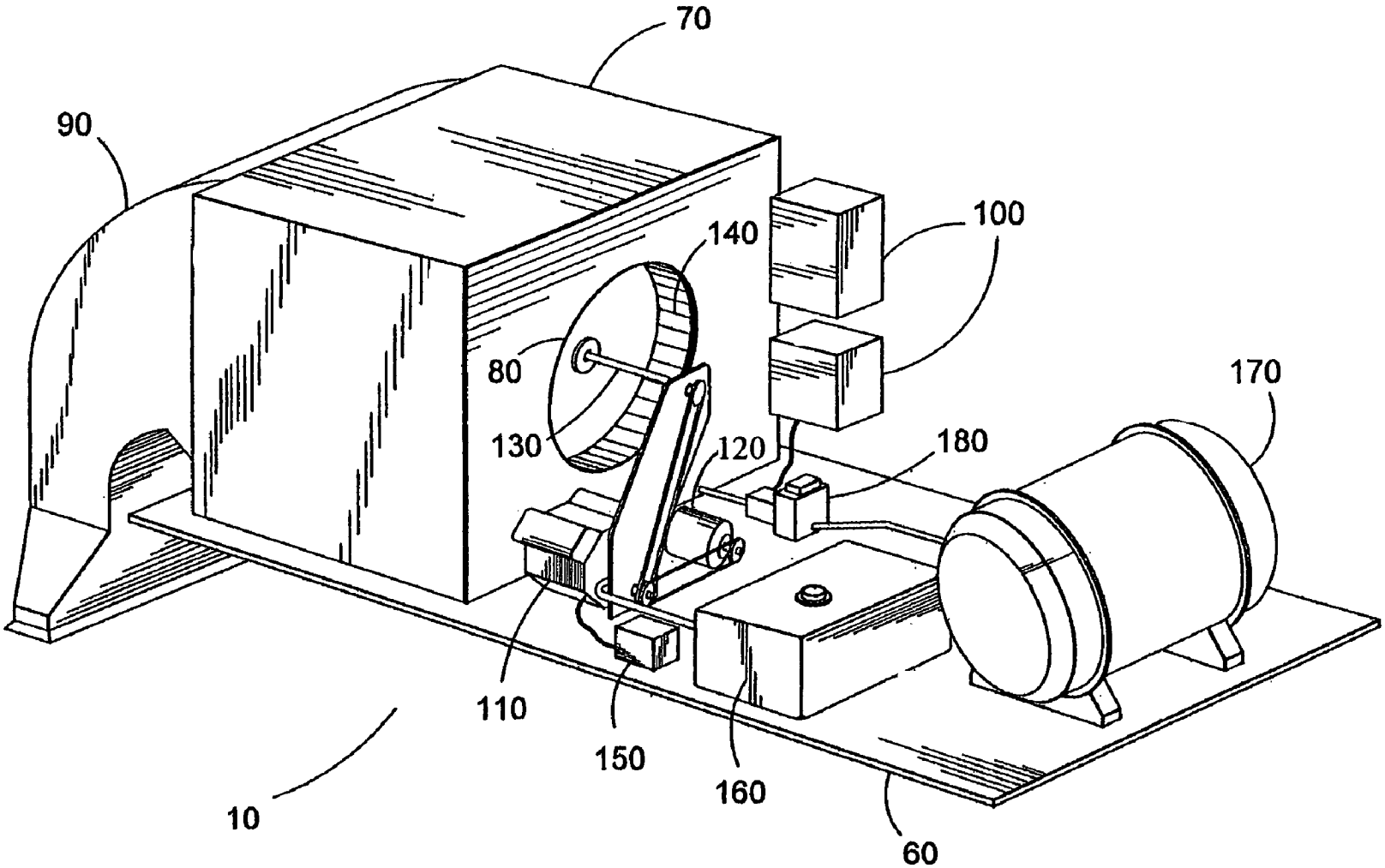
FIG. 4 is a schematic depiction of the elements of the preferred embodiment of the ground surface drying apparatus.

Reference will be made now to FIG. 4 to illustrate more elements of the apparatus 10. Again the same numbers will be used with the same elements. In the central area of the deck 60 is mounted an internal combustion engine 110 which has on it's shaft a set of pulleys for belts. From one pulley, a belt drives an electrical generator 120 which develops the electrical power needed for the controls of the apparatus 10. From another pulley, a belt runs to a shaft 130 that drives the fan 140 located in the fan box 70. Also centrally located on the deck 60 are a battery 150 and gasoline tank 160. The battery 150 is kept charged by the generator 120. The gasoline tank 160 holds the fuel for the internal combustion engine 110. At the front of the apparatus 10, a fuel storage tank 170 is mounted on the deck 60. For the present embodiment, this is a propane or LPG tank. Standard lines and valving connect the fuel source to the heater. For example, a fuel line runs to safety solenoid valve 180 which has its controls in control panels 100. Generator 120 provides the electricity necessary to operate the apparatus with the safety controls typical of a fuel powered heater.

To operate the ground surface drying apparatus 10, it should be hitched to a vehicle capable of towing it at sufficient speeds. The internal combustion engine 110 is started to generate electrical power for the heater within the duct 90 and the fan 140 is also being driven. For hot air operation, the heater is started. Controls allow for variation of heat addition, but the fan speed is determined by engine speed and belt pulley ratios. Air is blown into the heater by the fan 140 and is directed towards the ground surface. Alternatively the fan 140 can be run without using the heater.

Figure 5:
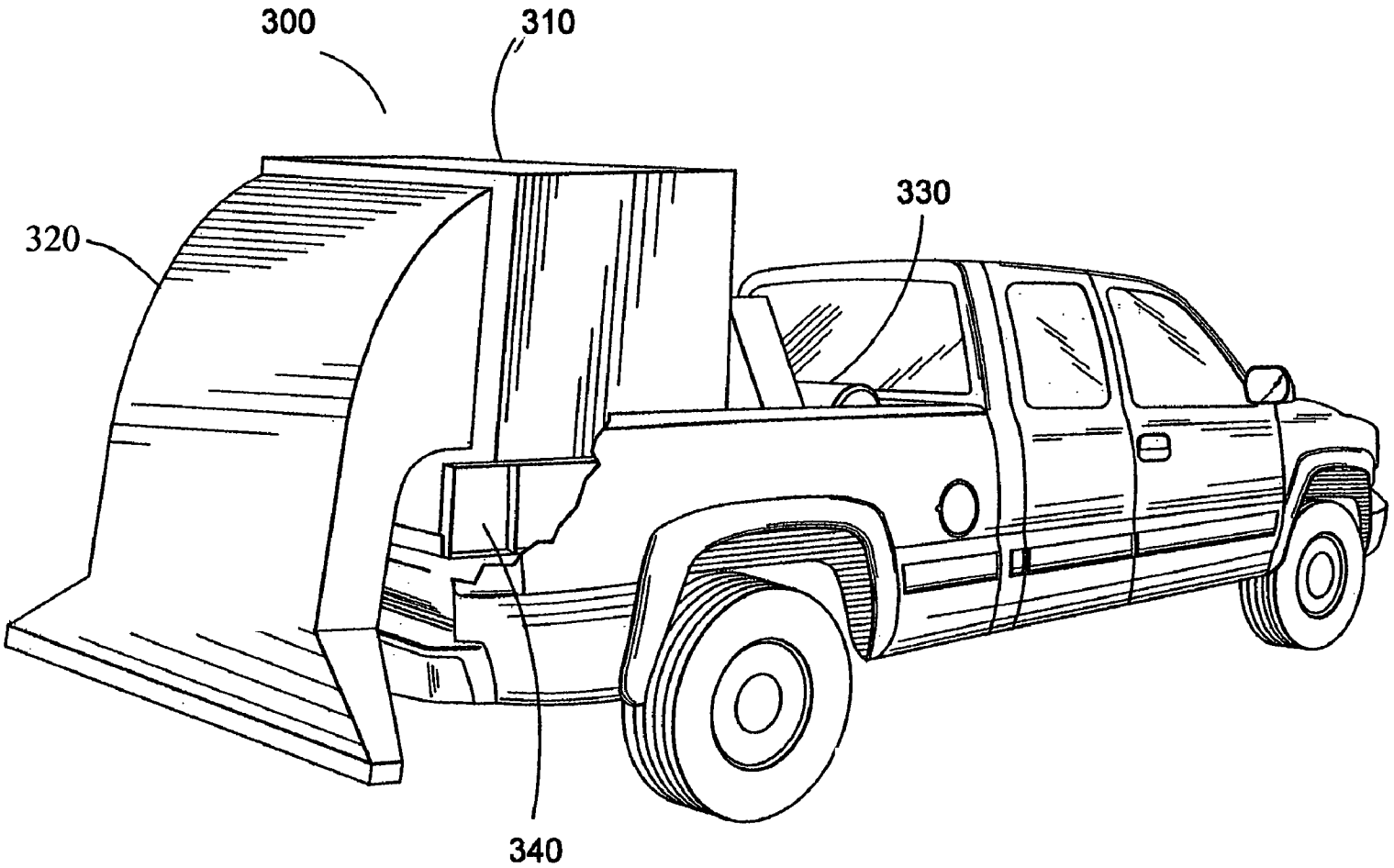
FIG. 5 shows an alternative embodiment of the ground surface drying apparatus carried by a truck.

FIG. 5 shows an alternative embodiment of the invention wherein the drying apparatus 300 is made to fit the cargo bed of a truck. The fan box 310, duct with heater 320, fuel tank 330, and other components are mounted to frame 340 which makes drying apparatus 300 a modular unit suitable to be carried by a typical truck.

Whatever the specific embodiment, when used for the purpose of drying asphalt pavement, the ground surface drying apparatus operates in such a way that the very surface of asphalt pavement is heated sufficiently to evaporate moisture but not heated excessively to the point of softening the pavement or driving off any petroleum constituents in the pavement. The velocity of the air is sufficient to dispel standing water and dry residual moisture as the drying apparatus is towed over the track surface. The high air velocities involved and the proximity of the duct nozzle to the surface cause a rapid transition from laminar air flow to a turbulent flow regime further assisting the removal of moisture from the surface to ambient air.

Figure 6:
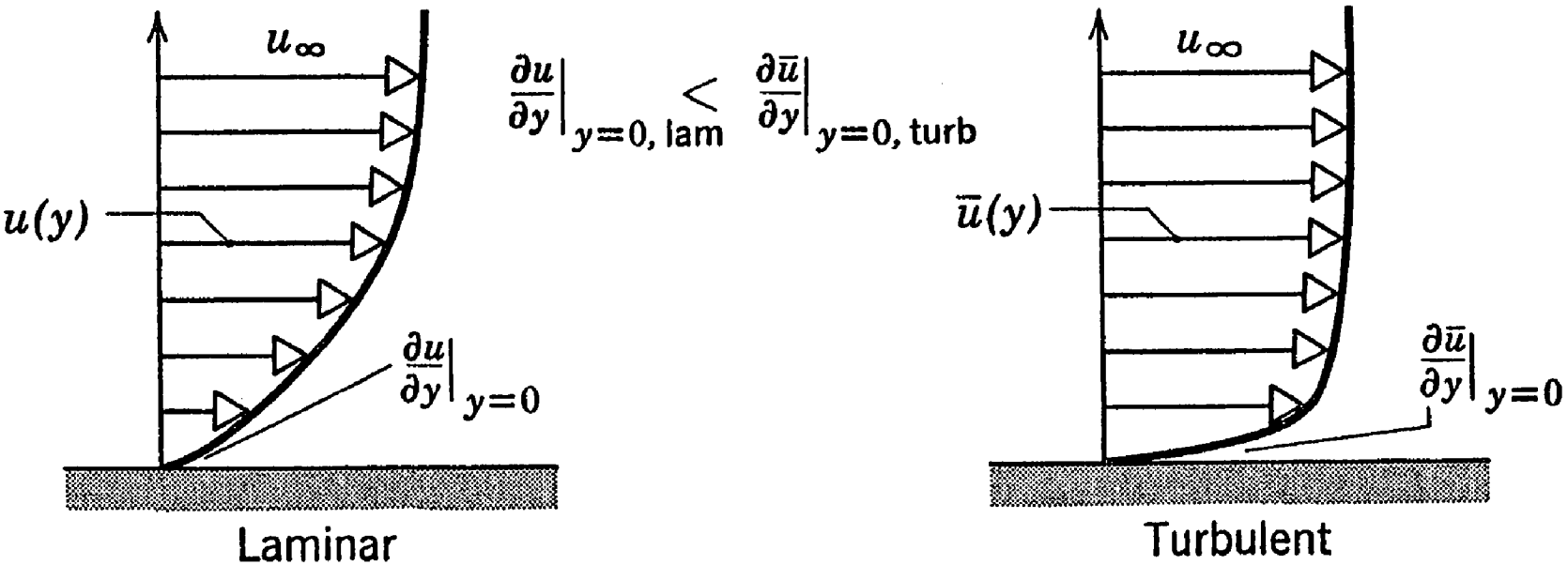
FIG. 6 shows the difference in velocity profiles between laminar flow and turbulent flow illustrating one of the process advantages of the present invention. This figure is a reproduction of FIG. 6.17 from pg 295 of Fundamentals of Heat and Mass Transfer, by Frank P. Incropera & David P. Dewitt, 2$^{nd}$ ed., 1985.

FIG. 6 illustrates the different velocity profiles of a laminar boundary layer and a turbulent boundary layer. It is an illustration from page 295, of Fundamentals of Heat and Mass Transfer, by Frank P. Incropera, and David P. Dewitt, $2^{nd}$ ed. 1985. As can be seen in FIG. 6, the velocity gradient from the surface to the core of the flow in the turbulent boundary layer is much greater than that in the laminar boundary layer. While the uniform average velocity in the turbulent boundary layer is depicted by the arrows of equal length, the turbulent boundary layer consists of eddies tumbling and interacting with each other. This action enhances the diffusion of moisture from the surface up into the higher levels of the turbulent boundary layer. Laminar flow is characterized by a more gradually increasing velocity profile. In such a flow regime, the diffusion of moisture will be more dependent on molecular diffusion, somewhat similar to evaporation into still air where the molecules disperse as a function of vapor pressure. In contrast, the mixing of the turbulent flow regime disperses the moisture upward and reduces vapor pressure at the surface while heating the surface, further enhancing the removal of moisture.

When used for the purpose of drying a dirt type track, the relative rates of the fan and the heat addition from the heater are changed, compared to those for drying asphalt. The speed of the fan is decreased while the temperature of the air is increased. The resulting combination of slower air flow with higher temperature dries the ground surface with less airborne dust being generated.

While a specific embodiment has been discussed for the sake of illustrating the current invention, particulars of the description of the embodiment should not be construed as limiting the invention. Those well versed in the art can see the wide range of applications for such an apparatus with its high degree of adaptability. The independent operation of the air blowing means, the air heating means, and the means of conveying the apparatus, allows a wide variation of embodiments for the invention.

I claim:

1. A ground surface drying apparatus, comprising:

a) a fan for blowing non-recirculating air, said fan being driven by an internal combustion engine;

b) a heater for heating said non-recirculating air;

c) a duct for directing said non-recirculating air to a section of said surface, and;

d) a wheel for moving said apparatus along said surface;

e) wherein, said heater burns fuel directly in the flow of said non-recirculating air.

2. The ground surface drying apparatus of claim 1, wherein;

the controls for said heater are powered by an onboard generator.

3. The ground surface drying apparatus of claim 2, wherein;

said onboard generator is driven by an internal combustion engine.

4. The ground surface drying apparatus of claim 1, further comprising;

a trailer chassis having wheels and a hitch for attaching to a towing vehicle.

5. The ground surface drying apparatus of claim 4, wherein;

the other elements of said apparatus are built upon said chassis.

6. The ground surface drying apparatus of claim 1, further comprising;

a structural frame upon which the other elements of said apparatus are built, said structural frame fitting into, or upon a self-propelled vehicle.

7. The ground surface drying apparatus of claim 1, further comprising;

a self-propelled vehicle upon which the other elements of said apparatus are built.

8. A method of drying a ground surface, comprising;

a) taking air into a blower;

b) passing said air through a heater which heats said air by burning fuel directly in the flow of said air, wherein the controls for said heater are powered by an onboard generator;

c) directing said air through a duct toward said surface without recirculating said air, while d) moving said blower, heater, and duct along said ground surface.

9. The method of claim 8, wherein;

said generator is driven by an internal combustion engine.

10. The method of claim 8, wherein;

said ground surface is asphalt.

11. The method of claim 10, wherein;

the temperature of the asphalt is kept below the temperature at which asphalt loses its structural rigidity.

12. The method of claim 8, wherein;

said ground surface is earthen material.

13. The method of claim 8, wherein;

said blower is driven by an internal combustion engine.

14. A mobile hot air generating apparatus comprising:

a structural frame;

a first reservoir of a first fuel mounted on said structural frame;

a heater mounted on said structural frame and capable of receiving and burning said first fuel;

electrical controls mounted on said structural frame, said electrical controls controlling the reception and burning of said first fuel by said heater;

a generator mounted on said structural frame, said generator providing electricity to said electrical controls;

a second reservoir of a second fuel mounted on said structural frame;

an internal combustion engine mounted on said structural frame and receiving and consuming said second fuel, said internal combustion engine driving said generator;

a blower mounted on said structural frame, said blower blowing non-recirculating air through said heater, said blower being driven by said internal combustion engine;

a duct for directing said non-recirculating air blown through said heater by said blower as said non-recirculating air exits said heater; and, means for moving said structural frame, said means comprising at least one wheel attached to said structural frame and a hitch extending from said structural frame, said hitch being adapted to connect to a self-propelled vehicle propelled by its own internal combustion engine.

15. A mobile hot air generating apparatus comprising:

a structural frame;

a first reservoir of a first fuel mounted on said structural frame;

a heater mounted on said structural frame and capable of receiving and burning said first fuel;

electrical controls mounted on said structural frame, said electrical controls controlling the reception and burning of said first fuel by said heater;

a generator mounted on said structural frame, said generator providing electricity to said electrical controls;

a second reservoir of a second fuel mounted on said structural frame;

an internal combustion engine mounted on said structural frame and receiving and consuming said second fuel, said internal combustion engine driving said generator;

a blower mounted on said structural frame, said blower blowing non-recirculating air through said heater, said blower being driven by said internal combustion engine;

a duct for directing said non-recirculating air blown through said heater by said blower as said non-recirculating air exits said heater; and, means for moving said structural frame, said means comprising a self-propelled vehicle, said structural frame being carried by said self-propelled vehicle, said self-propelled vehicle being propelled by its own internal combustion engine.

16. The mobile hot air generating apparatus of claim 15, wherein:

said self-propelled vehicle has a cargo bed, said structural frame being dimensioned to fit in and be carried in said cargo bed, the elements mounted on said structural frame operating to generate hot air while said structural frame is carried in said cargo bed.

17. A mobile hot air generating apparatus comprising:

a structural frame;

a first reservoir of a first fuel mounted on said structural frame;

a heater mounted on said structural frame and capable of receiving and burning said first fuel;

electrical controls mounted on said structural frame, said electrical controls controlling the reception and burning of said first fuel by said heater;

a generator mounted on said structural frame, said generator providing electricity to said electrical controls;

a second reservoir of a second fuel mounted on said structural frame;

an internal combustion engine mounted on said structural frame and receiving and consuming said second fuel, said internal combustion engine driving said generator;

a blower mounted on said structural frame, said blower blowing non-recirculating air through said heater, said blower being driven by said internal combustion engine;

a duct for directing said non-recirculating air blown through said heater by said blower as said non-recirculating air exits said heater; wherein, said structural frame is dimensioned to fit in the cargo bed of a self propelled vehicle, said self-propelled vehicle being propelled by its own internal combustion engine.

* * * * *